US005099256A

United States Patent [19]

Anderson

[11] Patent Number: 5,099,256

[45] Date of Patent: Mar. 24, 1992

[54] INK JET PRINTER WITH INTERMEDIATE DRUM

[75] Inventor: David G. Anderson, Ontario, N.Y.

[73] Assignee: Xerox Corporation, Stamford, Conn.

[21] Appl. No.: 617,221

[22] Filed: Nov. 23, 1990

[51] Int. Cl.[5] ..... B41J 2/05

[52] U.S. Cl. ..... 346/1.1; 346/140 R; 346/25

[58] Field of Search ..... 346/25, 140 R, 1.1, 346/75

[56] References Cited

U.S. PATENT DOCUMENTS

| | | | |
|---|---|---|---|
| 4,293,866 | 10/1981 | Takita et al. | 346/140 R |
| 4,463,359 | 7/1984 | Ayata et al. | 346/1.1 |
| 4,538,156 | 8/1985 | Durkee et al. | 346/21 |
| 4,571,599 | 2/1986 | Rezanka | 346/140 R |
| 4,673,303 | 6/1987 | Sansone et al. | 400/126 |
| 4,751,528 | 6/1988 | Spehrley, Jr. et al. | 346/140 R |
| 4,829,324 | 5/1989 | Drake et al. | 346/140 R |
| 4,925,895 | 5/1990 | Heeks et al. | 524/714 |

*Primary Examiner*—Benjamin R. Fuller

*Assistant Examiner*—Victor DeVito

*Attorney, Agent, or Firm*—Robert A. Chittum

[57] ABSTRACT

An ink jet printer is disclosed having a rotatable intermediate drum having a thermally conductive surface on which the ink droplets are printed from the printhead. The drum surface material is a suitable film forming silicone polymer having a high surface energy and surface roughness to prevent movement of the droplets after impact thereon. The printhead is located relative to the intermediate drum surface so that the ink droplets impact the drum surface with a large contact angle and the ink droplet image is transferred at a second location spaced from the printhead to minimize contaminating particles from the recording medium from reaching the printhead nozzles. The intermediate drum surface is heated to dehydrate the ink droplets prior to transfer from the intermediate drum to the recording medium. The silicone polymer coating enables substantially complete transfer of the dehydrated droplets to the recording medium, so that subsequent removal of the residual ink from the drum by a cleaning system is eliminated.

9 Claims, 3 Drawing Sheets

INK JET PRINTER WITH INTERMEDIATE DRUM

BACKGROUND OF THE INVENTION

This invention relates to drop-on-demand ink jet printing systems and more particularly, to a thermal ink jet printer having an intermediate drum to receive the ink droplets where the droplets are dehydrated prior to transfer to a recording medium, such as paper.

Thermal ink jet printing systems use thermal energy selectively produced by resistors located in capillary filled ink channels near channel terminating nozzles, or orifices, to vaporize momentarily the ink and form bubbles on demand. Each temporary bubble expels an ink droplet and propels it towards a recording medium. The printing system may be incorporated in either a carriage type printer or a pagewidth type printer. The carriage type printer generally has a relatively small printhead containing the ink channels and nozzles. The printhead is usually sealingly attached to a disposable ink supply cartridge and a combined printhead and cartridge assembly is reciprocated to print one swath of information at a time on a stationarily held recording medium, such as paper. After the swath is printed, the paper is stepped a distance equal to the height of the printing swath, so that the next printed swath will be contiguous therewith. The procedure is repeated until the entire page is printed. For an example of a cartridge type printer, refer to U.S. Pat. No. 4,571,599 to Rezanka. In contrast, the pagewidth printer has a stationary printhead having a length equal to or greater than the width of the paper. The paper is continually moved past the pagewidth printhead in a direction normal to the printhead length and at a constant speed during the printing process. Refer to U.S. Pat. No. 4,463,359 to Ayata et al and U.S. Pat No. 4,829,324 to Drake et al for examples of pagewidth printheads.

The major problems associated with producing images directly on plain paper with ink jet technology are the feathering of the image due to ink migration down paper fibers, bleeding of the ink from color to color when producing multi-color images, and a liquid carrier of the ink colorant being absorbed by the paper which produces paper waviness, commonly referred to as cockle.

U.S. Pat. No. 4,538,156 to Durkee et al discloses an ink jet printer wherein an intermediate transfer drum is shown. A transfer drum and printhead are mounted between side plates. The printhead is spaced from the drum, and the printhead nozzles are spaced at equal distances along a line which is parallel to the axis of the drum. The printhead is movable in steps so that on successive rotations of the drum, each nozzle is directed to a new track of a succession of tracks. After all tracks of the transfer drum have been served by a nozzle, a printing medium, such as paper, is brought into rolling contact with the drum to transfer the information on the drum to the printing medium while the printhead is returned to a starting position. The drum is then wiped clean in preparation for receiving the next page of information.

U.S. Pat. No. 4,293,866 to Takita et al discloses a recording apparatus wherein a liquid drop generator is shown which generates ink spots which are formed on an intermediate drum and then transferred onto a paper. The intermediate drum shows an apparatus for color ink jet printing. The intermediate drum has a surface containing the dye or pigment and the ink droplets impact the drum surface, wetting the dye or pigment carrying layer, making it transferable to a recording sheet, together with the liquid whereby a visible printing image may be transferred onto the recording sheet when placed in contact with the intermediate drum by an impression cylinder.

U.S. Pat. No. 4,673,303 to Sansone et al discloses a postage meter utilizing an offset printing roll. A dye plate carried by the roll has a first region for receiving fixed information and a second region for receiving variable information from an ink jet printer. At the beginning of a revolution of the printing roll, the second region is depressed and an inking roll applies ink to the first region. Then the second region is moved into the plane of the first region and an ink jet printing device ejects and propels ink droplets onto the second region to form the variable information thereon. A quality of the printed form of the variable information is sensed. If acceptable, a document is printed. If unacceptable, the first and second regions are both wiped clean and the entire operation is repeated.

The above patents solve some problems associated with ink jet printing which produce images on plain papers, but the major problems of image feathering, color to color bleeding, and paper cockle has not been solved.

SUMMARY OF THE INVENTION

It is an object of the present invention to provide an intermediate drum having a surface to receive the ink droplets from the printhead. The intermediate drum surface has a coating of material which is impervious to the ink and enables substantially 100% of the ink to be transferred therefrom to a recording medium, such as paper.

It is another object of the invention to provide an intermediate drum surface for receiving the ink droplets from the printhead which is thermally conductive and heated to dehydrate the ink droplets residing thereon prior to transfer to the final recording medium.

In the present invention, a thermal ink jet printer has a printhead with a linear array of nozzles for ejecting and propelling liquid ink droplets on demand to a rotatable intermediate drum having a thermally conductive surface for receiving the ink droplets. The drum has an axis about which it is rotated and the drum surface material is a suitable film-forming silicone polymer having a high surface energy and surface roughness to prevent movement of the droplets after receipt by the drum surface. The printhead nozzles confront the intermediate drum surface and are spaced a predetermined distance therefrom in a plane which is parallel to a tangent line to the drum surface, so that the ink droplets impact the drum surface normally to keep the momentum of the droplet from moving its location after it impacts the drum surface. The silicone polymer material on the drum surface causes the droplet to bead up thereon forming a large contact angle between the droplet and the drum surface to control the ink spreading on the drum prior to transfer to the recording medium. A drive means rotates or rotatably steps the drum surface past a first printer process location where the printhead ejects the droplets onto the drum surface, then past a second printer process location where the ink droplets in image formation are transferred to a recording medium, such as paper. The spacing of the two printer process locations prevent contaminating particles from the recording medium from reaching the printhead nozzles at the first location. The drum surface is heated to dehydrate the ink droplets, which form the information on the drum surface, to minimize print quality degradation after transfer to a recording medium. The film-forming silicone polymer coating on the surface of the intermediate drum, enables substantially complete transfer of the dehydrated ink droplets therefrom to the recording medium, so that removal of residual ink from the drum surface by a cleaning means, such as a wiper blade, is unnecessary. The dehydrated ink droplets eliminate feathering of the image on the paper, prevents the ink color from bleeding into adjacent colors, and eliminates the cockle problem.

The foregoing features and other objects will become apparent from a reading of the following specification in conjunction with the drawings, wherein like parts have the same index numerals.

DESCRIPTION OF THE PREFERRED EMBODIMENT

Figure 1:
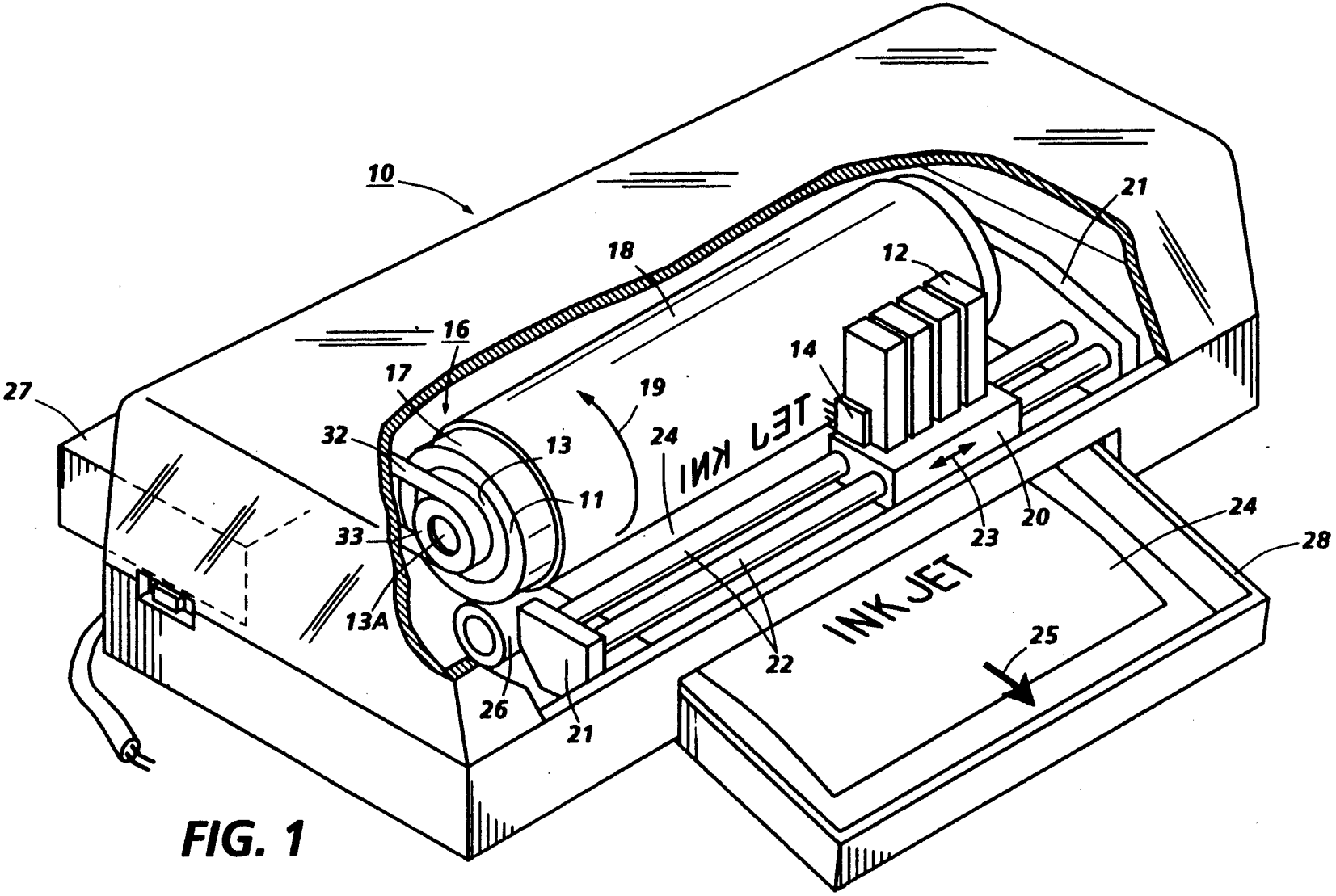
FIG. 1 is a schematic isometric view of a multi-color, carriage type, thermal ink jet printer having an intermediate drum for receiving the ink droplets from printheads integrally attached to ink cartridges mounted on a translatable carriage.

In FIG. 1, a multicolor thermal ink jet printer 10 is shown containing several disposable ink supply cartridges 12, each with an integrally attached printhead 14. The ink cartridge and printhead combination are removably mounted on a translatable carriage 20 disposed in a first process location adjacent the periphery of an intermediate drum 16. During the printing mode, the carriage reciprocates back and forth on, for example, guide rails 22, parallel to the axis of intermediate drum 16 as depicted by arrow 23. The intermediate drum has a diameter of between 10 and 20 cm and is constructed, for example, out of an aluminum sleeve 11 with endcaps 13 containing a shaft 13A therethrough which has a pulley 33 mounted on one end and driven by timing belt 32 via a stepping motor (not shown). The intermediate drum shaft is rotatably mounted in frame sides 21 which also contain the ends of guide rails 22. The carriage is driven back and forth across the length of the intermediate drum by well known means such as, for example, by cable and pulley with a reversible motor (not shown). Sleeve surface 17 of intermediate drum 16 contains a coating 18 of any suitable silicone film-forming polymer having a thickness of 60 to 70 mils. Silicone film-forming polymers are well known in the art. Typical examples of which are described in U.S. Pat. Nos. 4,373,239 to Henry et al; 4,711,818 to Henry; and 4,925,895 to Heeks et al, incorporated herein by reference in their entirety. As disclosed in U.S. Pat. No. 4,373,239, a silicone polymer layer is impregnated with iron oxide to serve as a reinforcing agent in the composition and to enhance its thermal conductivity. The suitable silicone polymer coating has a sufficiently high surface energy and surface roughness to cause the droplets impacting thereon to bead up and form a high contact, explained later with respect to FIGS. 4A and 4B, as well as to prevent movement of the droplets. This silicone film-forming polymer also enables the ink droplet image on the intermediate drum to be substantially completely transferred to the final recording medium 24, such as, for example, paper. Since this material enables the complete transfer of the ink droplet image to the paper, a release agent is not required to be applied to the silicone polymer coating surface prior to printing of the ink droplets thereon, and it does not need to be cleaned after the transfer of the ink droplet image and prior to printing of ink droplets again thereon.

In a second location, spaced at least 90° from the drum location where the printing is conducted, a nip is formed by a transfer roll 26 through which a recording medium 24, such as paper is moved in the direction of arrow 25, so that the ink droplets are transferred thereto. In a carriage type printer, the intermediate drum is held stationary while the carriage is moving in one direction and prior to the carriage moving in a reversed direction. The intermediate drum is stepped in the direction of arrow 19 a distance equal to the height of the swath of data printed thereon by the printheads 14 during traversal in one direction across the intermediate drum. The droplets are ejected on demand from the nozzles of the printheads to the silicone polymer coating on the drum, where the droplets form reverse reading information, so that after transfer to a recording medium, such as paper, the information is right reading. The front face of the printhead containing the nozzle is spaced from the intermediate drum coating a distance of between 0.01 and 0.1 inch, with a preferred distance being about 0.02 inches. The stepping rotational tolerance for the intermediate drum and the linear deviation of the printheads are held within acceptable limits to permit contiguous swaths of information to be printed without gaps or overlaps.

Each cartridge 12 contains a different ink, one black and one to three cartridges of different selected colors. The combined cartridge and printhead is removed and discarded after the ink supply in the cartridge has been depleted. In this environment, some of the nozzles do not eject droplets during one complete carriage traversal and generally, none of the nozzle eject droplets as the printheads move beyond the edge of the intermediate drum. While at this end of the carriage traversal, there is a small dwell time while the intermediate drum is being stepped one swath in height in the direction of arrow 19. A maintenance and priming station (not shown) is located on one side of the intermediate drum where the lesser used nozzles may fire nozzle-clearing droplets, and/or where the nozzles may be capped to prevent them drying out during idle time when the printer is not being used. A supply of cut sheet recording medium or paper 24 is provided in cassette 27 inserted in the back of the printer 10, from which the sheets are forwarded through the nip formed by the intermediate drum 16 and transfer roll 26 where the ink jet image is transferred to the paper and then the paper, with the image, is forwarded to output tray 28. The intermediate drum surface 17 and silicone polymer coating 18 are heated by means well known in the art such as, for example, resistive heaters on the internal surface of the sleeve making up the intermediate drum.

Figure 2:
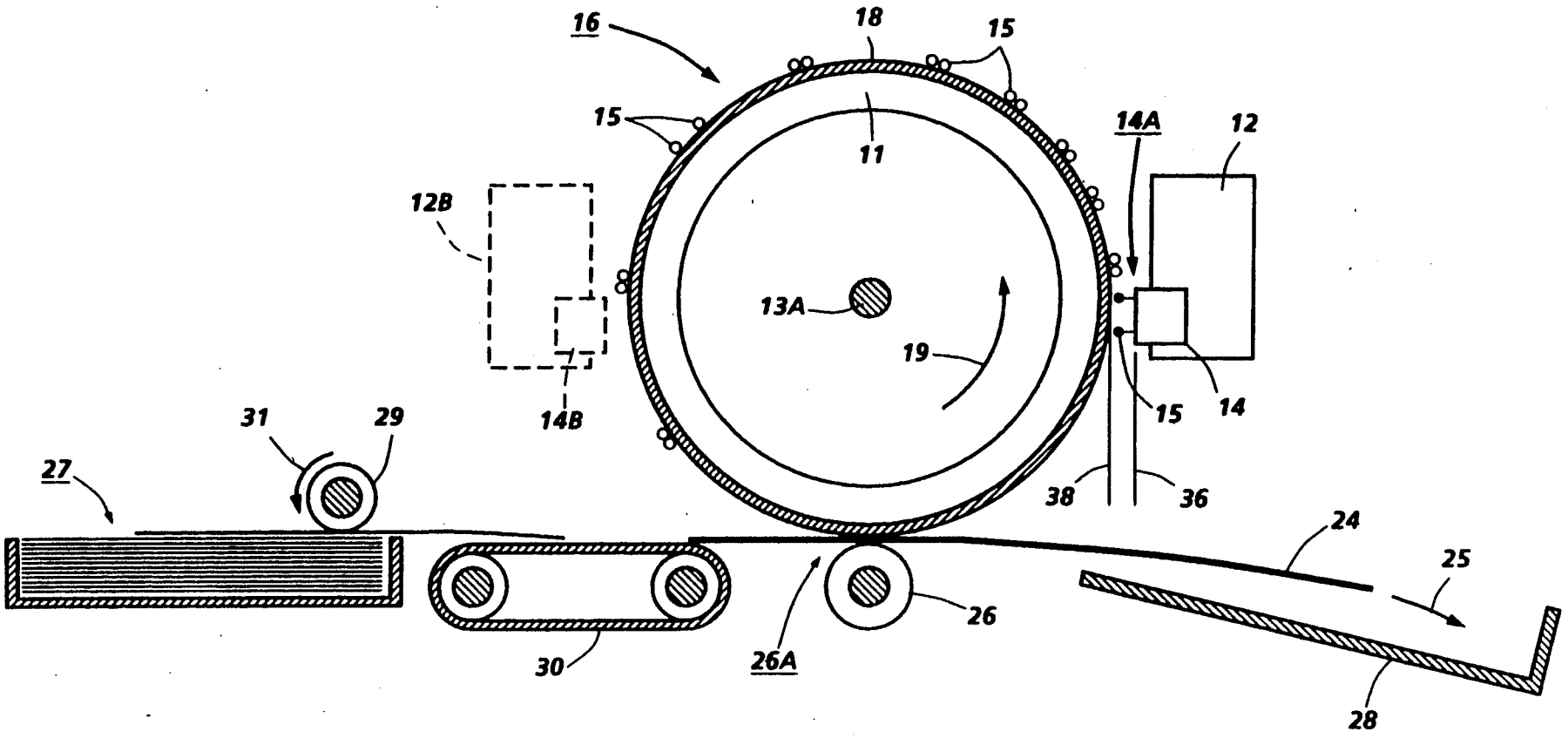
FIG. 2 is schematic side view of a portion of the printer of FIG. 1.

Referring to FIG. 2, a schematic cross-sectional side view shows the ink cartridge 12 and integral printhead 14 located in a first position or printing station 14A and a transfer station 26A at a second position formed by the intermediate drum 16 and transfer roll 26 urged thereagainst under a predetermined pressure. The printing station is spaced from the transfer station to minimize paper dust or paper fiber contamination from reaching the printhead, because such contamination could lead to clogged nozzles or droplet trajectory directionality problems. In FIG. 2, the printhead is located at the 3 o'clock position and the transfer station is located at the 6 o'clock position around the drum. This provides a 270° rotation of the drum between the printing station and the transfer station, thus offering maximum time to dehydrate the ink droplets on the drum surface. However, the printhead could be placed anywhere along the surface of the intermediate drum, so long as it stays at least 90° away from the transfer station. Thus, there is complete architectural freedom provided by allowing the printing location to be spaced from the transfer location without loss of contamination control from recording medium particles and without loss of ability to dehydrate the ink droplets forming the image on the intermediate drum. The intermediate drum could also be replaced with a belt system (not shown) allowing further freedom in the system design. The printhead nozzle array is located a preferred distance of about 0.02 inch from the silicone polymer coating on the intermediate drum surface in a plane 36 parallel to a plane or line 38 tangent to the drum surface. The droplets, therefore impact the surface of the drum substantially normal thereto, so that the droplet momentum does not cause the droplet to move from its impact location. Ink droplets 15 ejected from printhead 14 impact the silicone polymer coating 18 on drum 16 and, after the swath of information is printed, the drum is stepped in the direction of arrow 19 the distance of the height of the printed swath. The printhead 14B and cartridge 12B are shown in dashed line at another location to emphasize the flexibility of a printer with an intermediate drum. This optional location is at the 9 o'clock position.

Cut sheets of paper 24 are removed from cassette 27 by feed roll 29 moved in the direction of arrow 31 to place a sheet of paper on transport 30 for registration and alignment with the image on the silicone polymer coating 18 at the transfer station 26A formed by the nip between the intermediate drum and transfer roll 26. The intermediate drum could be sized so that one page of information could be transferred for each rotation of the drum of the diameter of the intermediate drum could be smaller and require more than one revolution to transfer a full page of information. The intermediate roll may also be used for a pagewidth thermal ink jet printer, wherein the printhead is stationary while the intermediate drum is rotated at a constant velocity. Printing directly on a belt or drum provides a definite advantage in color-to-color registration. By encoding the position of the intermediate medium (drum or belt), eliminates the need to align and monitor paper position. Thus, very tight tolerances are achievable with the intermediate drum printing system.

Figure 3:
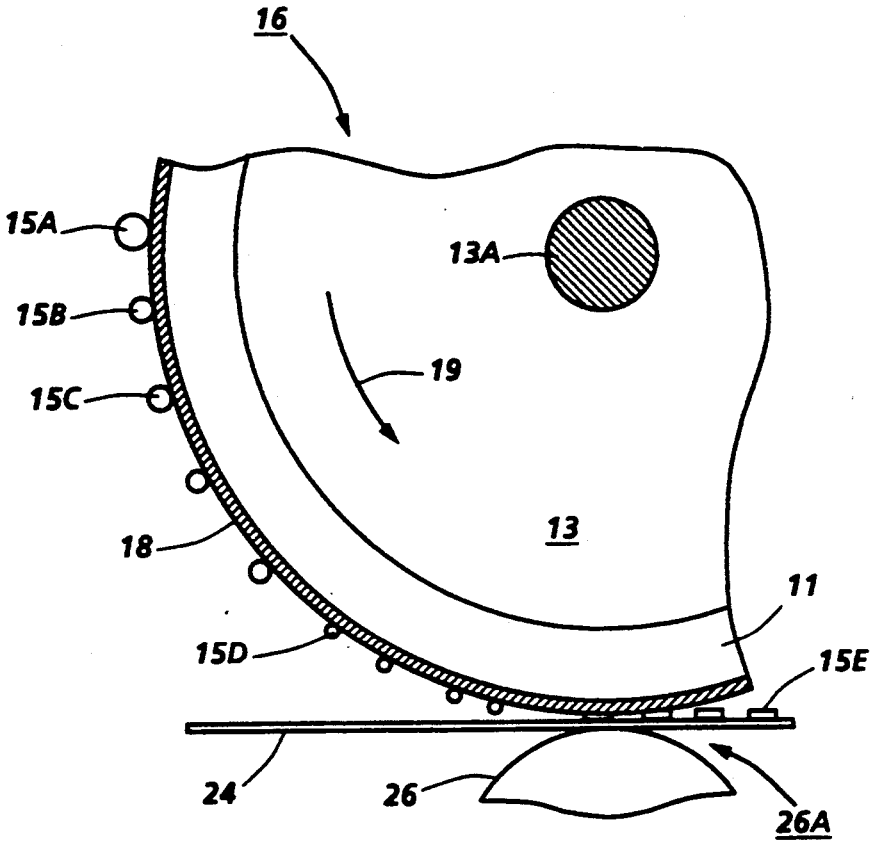
FIG. 3 is a partially shown enlarged side view of the intermediate drum, illustrating the dehydration of the ink droplets thereon and transfer therefrom to a recording medium.

FIG. 3 illustrates the dehydration of the ink droplets on the heated silicone polymer coating 18, thus showing a liquid droplet 15A which, as it is heated, evaporates the liquid therefrom, reducing the size from 15A to 15B to 15C and then to a fully dehydrated droplet at 15D prior to reaching the nip at the transfer station 26A. The dehydrated droplets have a high viscosity which is mechanically spread during the transfer to paper 24 by the pressure applied at the nip by transfer roll 26 which is somewhat compliant, thus producing a contact width much greater than mere linear contact. The silicone polymer coating enables substantially complete transfer of the dehydrated droplets to the paper, thus eliminating the need for a cleaning system to clean the intermediate drum surface and prepare it for receiving ink droplets from the printhead as the intermediate drum moves from the transfer location to the printing location. Homever, means for periodic cleaning of the silicone polymer coating 18 could optionally be provided in the form of a cleaning roll (not shown) which is manually or automatically moved into contact with the intermediate drum at a location positioned after image transfer and prior to the printing station. The dehydration of the ink droplet reduces the color-to-color intermixing problem by allowing undersized droplets to be used which would not touch until partially dehyrated and pressed into the paper at the nip. The smaller drops also enable use of less ink per page due to the spread factor at the nip as illustrated by the flatter, dehydrated droplet 15E at the transfer station nip and transfer to the paper 24.

Figure 4A:
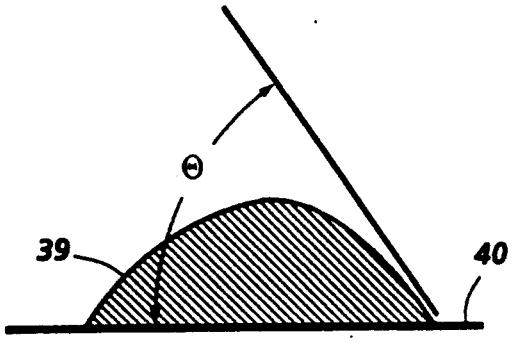
FIG. 4A is a schematic representation of a droplet on a surface having a low contact angle therewith.
Figure 4B:
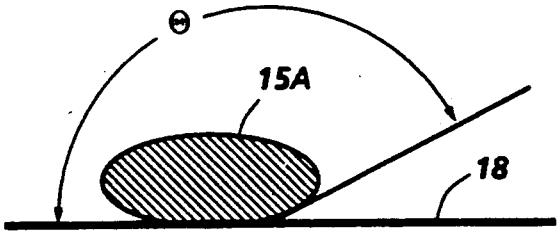
FIG. 4B is a schematic representation of a droplet on a surface having a high contact angle therewith.

FIG. 4A illustrates the low contact angle $\theta$ of a liquid ink droplet 39 sitting on a suface 40 which spreads after impact. The contact angle is the angle of the meniscus formed with the surface 40 at its interfacing perimeter, which in this FIG. 4A is about 45 degrees. Thus, the spread of adjacent droplets of different colors would cause undesired intermixing. For high quality printing, it is clearly desirable to have a surface which causes the liquid droplet to bead up and have a high contact angle as shown in FIG. 4B, where the contact angle $\theta$ is generally greater than 90 degrees and preferably about 110 degrees. In FIG. 4B, the surface is a suitable silicone polymer coating 18 as used on the intermediate drum of the present invention and has a high contact angle $\theta$ for droplet 15A of about 150 degrees.

Many modifications and variations are apparent from the foregoing description of the invention and all such modifications and variations are intended to be within the scope of the present invention.

I claim:

1. An ink jet printer having a printhead with a linear array of nozzles for ejecting and propelling liquid ink droplets on demand to form information on a receiving surface, comprising:

a rotatable intermediate drum having a thermally conductive surface for receiving ink droplets ejected from the printhead nozzles, the drum having an axis about which the drum is rotated, said drum surface being a suitable film-forming silicone polymeric material having a high surface energy and having a surface roughness to prevent movement of the droplets after receipt by the drum surface;

said array of nozzles adjacently confronting the drum surface and being spaced a predetermined distance therefrom in a plane which is parallel to a tangent line to the drum surface, so that the ink droplets impact the drum surface normally producing a large contact angle between the droplet and drum surface, the drum surface roughness in combination with the larger contact angle controlling droplet spread after impact, the droplets on the intermediate drum surface forming reverse reading information for subsequent transfer to a recording medium, whereupon the transferred information will be right reading;

means for rotating the drum surface past first and second spaced printer process locations, the droplets forming information on the drum surface at the first location, and the information being transferred from the drum surface to a recording medium at the second location, so that the spacing of the locations prevent contaminating particles from the recording medium at the second location from reaching the printhead nozzles at the first location; and means for heating the drum surface to dehydrate the ink droplets forming the information on the drum surface to minimize print quality degradation after transfer of the information to a recording medium, said drum surface material enabling substantially complete transfer of the dehydrated ink droplets therefrom to the recording medium, so that substantially no residual ink is left on the drum surface.

2. The printer of claim 1, wherein the imtermediate drum is a conductive sleeve having a suitable film-forming silicone polymer coating thereon.

3. The printer of claim 2, wherein the sleeve is aluminum, and wherein the silicone polymer coating contains iron oxide and is 60 to 70 mils thick.

4. The printer of claim 3, wherein the first and second process locations are spaced at least 90 degrees apart around the drum surface.

5. The printer of claim 4, wherein a portion of the drum surface is periodically cleaned after transfer of the information therefrom to the recording medium and prior to arrival of said portion at the first location where ink droplets are to be received again.

6. The printer of claim 1, wherein the printer contains a quantity of liquid ink therein for supplying said ink to the printhead; and wherein the dehydrated ink droplets are flattened during transfer from the drum to the recording medium, so that each spot produced by the droplet is enlarged whereby smaller droplets may be used to reduce the quantity of ink necessary for each page of information.

7. The printer of claim 6, wherein the transfer of dehydrated droplets is effected by a pressure transfer station comprising a transfer roll urged against the drum surface to produce a nip therebetween.

8. A method of producing information on a recording medium with an ink jet printer having a printhead which ejects ink droplets on demand from an array of nozzles therein, so that the information does not degrade or cause the recording medium to wrinkle because of absorption of the ink droplets into the recording medium, comprising the steps of:

(a) providing a rotatable intermediate drum with a surface between and adjacent an information printing location and an information transferring location in said printer, the drum surface being a suitable film-forming silicone polymeric material with suitable surface energy and surface roughness to prevent ink droplets received thereby from the printhead nozzles from moving or spreading;

(b) locating the printhead at the information printing location, the nozzles being confrontingly adjacent the drum surface, so that the ink droplets from the printhead nozzles impact the drum surface normally forming a large contact angle therewith, the large contact angle and the drum surface roughness controlling droplet spread or movement on the drum surface prior to transfer to the recording medium;

(c) rotating the drum during or after the printing of information on the drum surface to the transferring location;

(d) heating the printed ink droplets forming the information on the drum surface during the rotation of the drum surface from the printing location to the transferring location to dehydrate the ink droplets; and (e) transferring the dehydrated ink droplets forming the information to a recording medium at the transferring location, the drum surface material enabling substantially a complete transfer to the information produced by the dehydrated ink droplets from the drum surface to the recording medium without degradation of the information on the recording medium, so that cleaning of the drum surface is not required.

9. The method of claim 8, wherein the method further comprises the steps of:

(f) supplying a quantity of liquid ink to the priner from which the printhead is supplied and is replenished as said printhead ejects ink droplets from the nozzles; and wherein, during step (e), the dehydrated ink droplets are flattened during transfer from the drum surface to the recording medium, so that each spot produced by the droplet is enlarged, whereby smaller droplets may be used to reduce the quantity of ink necessary for each page of information printed.

* * * * *